US005128905A

United States Patent [19]

Arnott

[11] Patent Number: 5,128,905

[45] Date of Patent: Jul. 7, 1992

[54] ACOUSTIC FIELD TRANSDUCERS

[76] Inventor: Michael G. Arnott, Cavendish Lab., Madingley Road, Cambridge, CH3 0HE, England

[21] Appl. No.: 634,125

[22] PCT Filed: Jul. 17, 1989

[86] PCT No.: PCT/GB89/00820

§ 371 Date: Jan. 2, 1991

§ 102(e) Date: Jan. 2, 1991

[87] PCT Pub. No.: WO90/00730

PCT Pub. Date: Jan. 25, 1990

[30] Foreign Application Priority Data

Jul. 16, 1988 [GB] United Kingdom ..... 8816979

[51] Int. Cl.[5] ..... H04R 17/00

[52] U.S. Cl. ..... 367/140; 367/163; 367/180; 367/157; 310/334; 310/800

[58] Field of Search ..... 367/157, 160, 163, 174, 367/140, 178, 180; 310/800, 334

[56] References Cited

U.S. PATENT DOCUMENTS

| | | | |
|---|---|---|---|
| 4,051,395 | 9/1977 | Taylor | 310/800 |
| 4,315,433 | 2/1982 | Edelman et al. | 310/800 |
| 4,354,134 | 10/1982 | Micheron | 310/800 |
| 4,782,469 | 11/1988 | Granz et al. | 310/800 |

*Primary Examiner*—J. W. Eldred

*Attorney, Agent, or Firm*—Bell, Seltzer, Park & Gibson

[57] ABSTRACT

An acoustic field transducer (10) comprises an elastic membrane (15A) made of piezo-electric material and peripherally held in stretched condition with static strain. A major surface area of the membrane (15A) is free to move in response to acoustic field variations which are coupled to the membrane (15A). Electrical conductors (17) are connected to the membrane (15A) for collecting signals piezo-electrically generated by the membrane due to strain variations and which are a measure of the acoustic field variations. The acoustic field variations are coupled to the membrane (15A) in a variety of different arrangements.

10 Claims, 2 Drawing Sheets

ACOUSTIC FIELD TRANSDUCERS

This invention relates to acoustic field transducers.

Transduction of acoustic fields is required in a variety of applications where low-frequency vibration is encountered including geophysics, engineering, mechanical design and development, control systems, intrusion alarm systems, environmental noise monitoring, various medical monitoring systems, triggering, impact sensing, microphonics and hydrophonics.

In a known prior proposal disclosed in U.S. Pat. No. 4,326,275 a piezo-electric transducer element is used. The element is ceramic and flexural and gives rise to an acceleration sensitive device.

It is an object of the present invention to provide a new and improved form of acoustic field transducer. It is a further object to provide an acoustic field transducer which is velocity sensitive. It is a still further object to provide a new and improved method of acoustic field transduction.

Accordingly the present invention provides in one of its aspects an acoustic field transducer comprising an elastic membrane made of piezo-electric material peripherally held in stretched condition with static strain and having a major surface area which is free to move in response to acoustic field variations, means for coupling acoustic field variations to the membrane, and electrical conductor means connected to the membrane for collecting signals piezo-electrically generated by the membrane due to strain variations which are a measure of said acoustic field variations.

The present invention in another of its aspects also provides an acoustic field transducer comprising a rigid hollow support structure capable of being coupled to an acoustic field, the support structure housing an assembly forming an inertial reference mounted for movement relative to the support structure in one translational direction, the assembly including at least one elastic membrane made of piezo-electric material peripherally held in stretched condition with static strain and having a major surface area which is free from contact with the support structure and which extends transversely to said one direction, means interconnecting the support structure and the assembly to transfer to the inertial reference motion of the support structure via the membrane and to effect variations in the strain of the membrane consequential to said motion in said direction of translation, and electrical conductor means connected to the membrane for collecting signals piezo-electrically generated by said membrane due to strain variations which are a measure of said acoustic field variations coupled to the support structure, the assembly having a mechanical resonance frequency at or below which the transducer is sensitive to acoustic field frequencies, the output of the transducer being proportional to the relative velocity of motion between the inertial reference and the support structure.

The present invention also provides an acoustic field transducer comprising a hollow support structure capable of being coupled to an acoustic field, the support structure housing at least one elastic membrane made of piezo-electric material peripherally held in stretched condition with static strain and having a major surface area which is free from contact with the support structure, driver means connected to a flexural part of the support structure and engaging part of said major surface area to effect variations in the strain of the membrane consequential to movements of the driver means relative to the membrane and which are a measure of said acoustic field variations coupled to the flexural part of the support structure.

The present invention also provides a method of transducing acoustic fields comprising providing an elastic membrane made of piezo-electric polymeric material, holding the membrane in a static strain stretched condition, applying acoustic field variations to a part of the membrane which is free to move in a gaseous medium, and collecting piezo-electrically generated signals from the membrane as a measure of the acoustic field variations.

Each membrane may take the form of a single sheet of said polymeric material or may take the form of a bonded stack of such sheets. The piezo-electric polymeric material may, for example, be polyvinylidene fluoride (PVDF or PVdF) which has the particular advantage of providing the transducer with a linear response at or below the mechanical resonancy frequency (i.e. rectilinear amplitude and phase frequency relations).

The major surface area of the membrane which is free to move with respect to its surroundings, preferably in an atmosphere of air, may be planar or conforming to some other surface shape such as semi-cylindrical. The peripheral shape of the membrane may take any desired form such as circular, rectangular or square.

In the case where the transducer comprises a pair of membranes operating in like fashion the electrical conductors may be interconnected in common mode rejection format provided that the membranes have the same angular orientation as regards their piezo-electric properties. Where the major surface area of the or each membrane is contacted or penetrated by a driver the surface film electrodes on the membrane and to which the electrical conductors are connected may be locally removed to eliminate contact noise from the collected signal.

Embodiments of the present invention will now be described by way of example with reference to the accompanying drawings in which.

Figure 9:
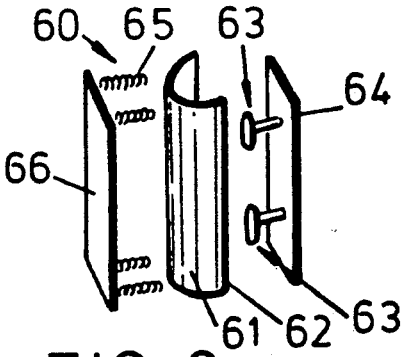
Figure 10:
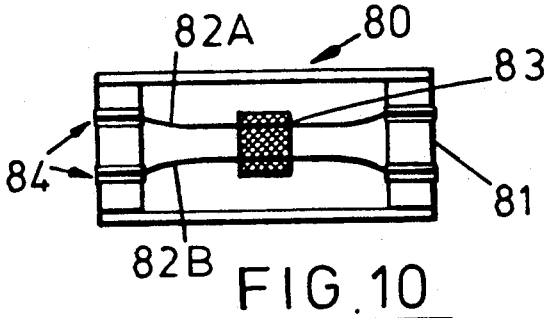
Figure 13:
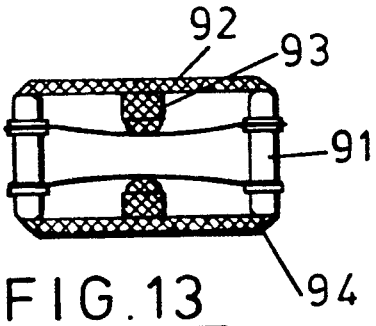
Figure 12:
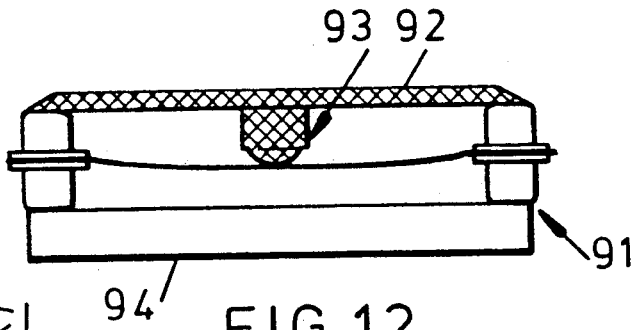
Figure 14:
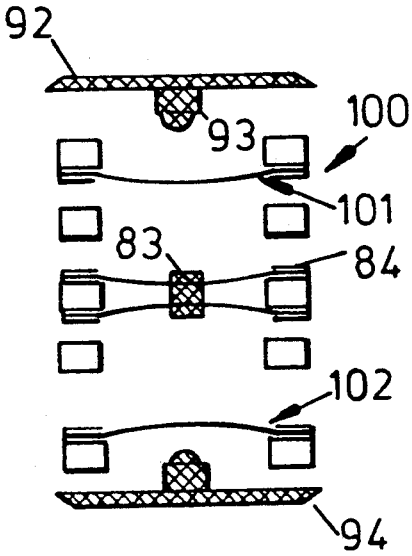
Figure 11:
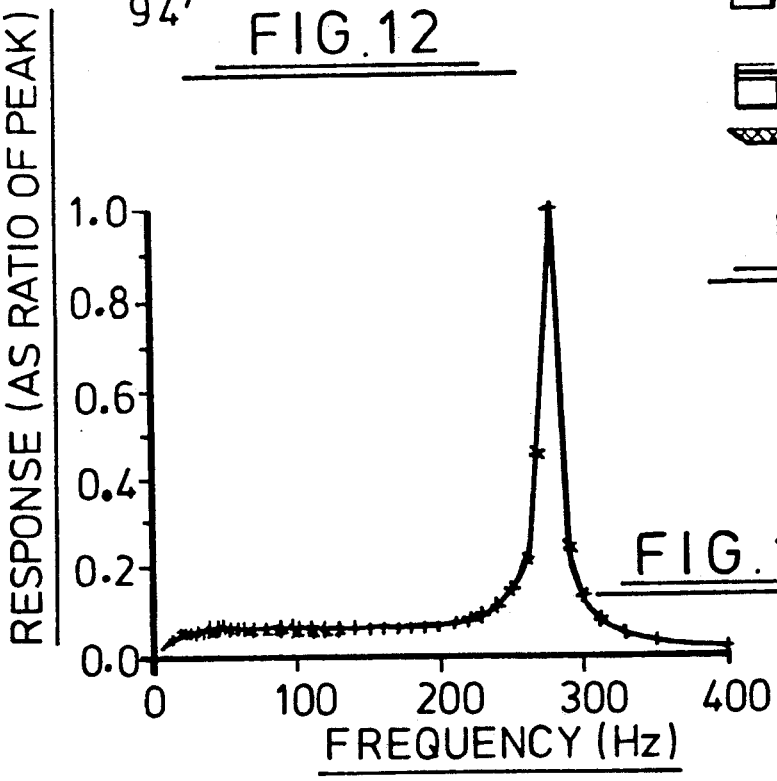

FIG. 9 schematically illustrates a still further form of acoustic field transducer according to the present invention in exploded form;

FIG. 10 illustrates a still further form of transducer according to the present invention;

FIG. 11 graphically illustrates typical response curves of transducers according to the present invention;

FIGS. 12 and 13 illustrate still further forms of transducer according to the present invention; and FIG. 14 illustrates a further form of transducer according to the present invention and in exploded form.

Figure 1:
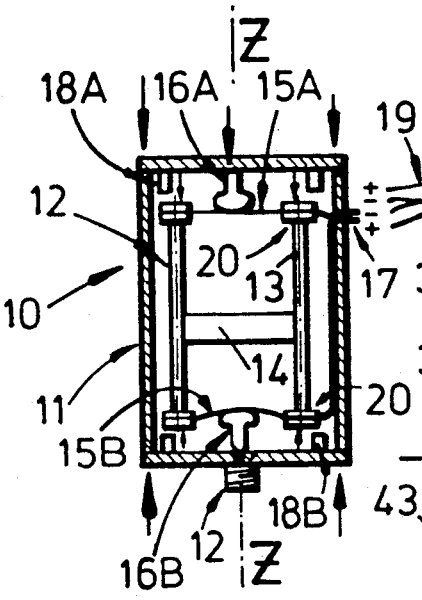
FIG. 1 illustrates an acoustic field transducer according to the present invention and including a first form of assembly.

The acoustic field transducer 10 which is shown in FIG. 1 comprises a hollow rigid support 11 which is capable of being mechanically coupled to a vibration source by way of a screw threaded spigot 12 which, for example, is capable of receiving a spike for penetrating into the earth to enable the transducer 10 to function as a geophone. Support 11 which is sealed against ingress of fluids contains an assembly 12 forming an inertial reference and in the FIG. 1 form includes a rigid tubular carrier 13 for an inertial mass 14, an upper membrane 15A and a lower membrane 15B, the membranes each being made of piezo-electric polymeric material and peripherally secured to the axially opposed ends of the carrier 13 by end clamp rings 20 or by adhesive bonding. The membranes 15A, 15B are in static strain due to their secural to the carrier 13 and except for their peripheral regions are free from contact with the carrier 13 over the major part of their surface areas. Because the membranes 15A, 15B are in a state of static strain the two dimensional Hooke's Law is obeyed. The support 11 has inwardly axially projecting formations 16A, 16B in abutting engagement with part of the major surface areas of the membranes 15A, 15B respectively so as to support the weight of the assembly 12 and its inertial mass 14, and electrical conductors 17 are connected to the membranes 15A, 15B for delivering signals piezo-electrically generated by the membranes due to strain variations therein to the exterior of the support 11 to thereby provide a measure of the vibration coupled to the housing 11 from the vibration source which in this instance is geophysical.

Vibrations which are coupled to the support 11 cause the support 11 to vibrate along the axis Z—Z with respect to the assembly 12 because the latter is relatively stationary due to its intertial mass 14 and the effect of the vibration is coupled on to the membrane 15A, 15B which are surrounded by a gaseous atmosphere by the formation 16A, 16B and appears as strain variations in the membranes 15A, 15B. Relative movement between support 11 and assembly 12 is restricted by annular end stops 18A, 18B formed on the support 11 for abutment with the membrane end clamp rings. When the rate of change of strain in the membranes 15A, 15B is below the mechanical resonance of the assembly 12 the response is effectively instantaneous and there is a conformal change in strain throughout each membrane. Lateral strain in each membrane is maximised and the output of the transducer is proportional to the relative velocity of motion between the assembly 12 and the support 11.

Figure 2:
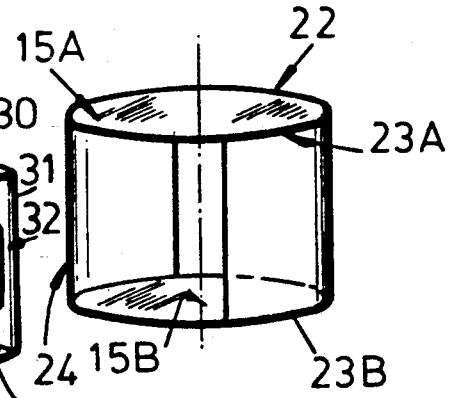
FIG. 2 illustrates a second form of the assembly.

As is illustrated in FIG. 2 a modified form of assembly 22 utilises a pair of end rings 23A, 23B held in spaced apart relationship by a plurality of bars 24, the membranes 15A, 15B being secured to the end rings 23A, 23B as before and in this instance the inertial mass is provided by the weight of the bars 24.

Figure 3:
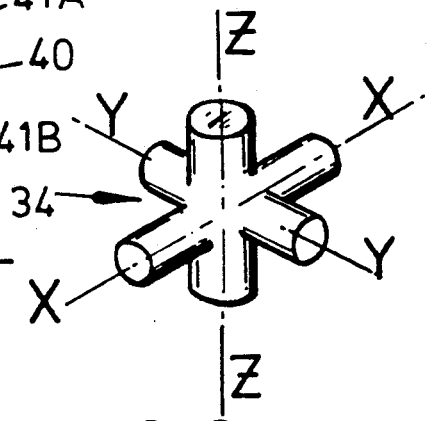
FIG. 3 illustrates a third form of the assembly.

It will be appreciated from the constructions illustrated in FIGS. 1 and 2 that the detector 10 is sensitive to motion only along the axis Z—Z shown in FIG. 1; whereas the FIG. 3 construction of assembly 34 which effectively consists of three intersecting mutually orthogonal, preferably independent, cylinders provides the assembly 34 with sensitivity in each of the three mutually orthogonal directions X—X, Y—Y, Z—Z, each such cylinder carrying piezo-electrical membranes on its opposed end faces and in abutment with respective formations like formations 16A, 16B secured to the support structure (not shown).

In each instance the assembly 12, 24, 34 has a mechanical resonance frequency around and below which the transducer 10 is sensitive to vibrational frequencies. It is preferred that the mechanical resonance frequency is of the order of 200 Hz which is achieved by selection of the magnitude of mass 14 and the dimensions of the assembly. Conductors 17 comprise a pair of wires connected via electrodes to each of the membranes 15A, 15B the wires being interconnected in common mode rejection format as denoted at 19 in FIG. 1 with the two membranes 15A, 15B mounted in the same angular orientation as regards their piezo-electric properties. This configuration enables cancellation of interfering electro-magnetic and pyroelectric signals. The piezo-electric polymeric material which forms the membranes 15A, 15B is either a single sheet or a stack of bonded sheets of PVDF which provides the transducer 10 with a rectilinear amplitude and phase frequency relationship below the region of the mechanical resonance frequency.

The FIG. 1 construction in particular is rugged and can be rendered light in weight and easy to manufacture, for example, by constructing all components except the membranes 15A, 15B of a rigid plastics material such as Tufnol (RTM). In particular, with an inertial mass having a weight of 25 grammes and each membrane having a diameter of 20 mm and made of PVDF sheet 40 μm in thickness the transducer 10 is provided with a mechanical resonance frequency of 200 Hz and exhibits a linear response to frequencies at or below that level. For an inertial mass of 10 gm and 20 mm diameter membranes of 25 μm PVDF sheet the transducer mechanical resonance frequency is about 300 Hz.

Figure 4:
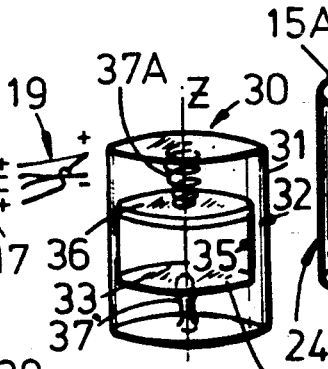
FIG. 4 illustrates another form of acoustic field transducer according to the present invention and including a fourth form of the assembly.

In the transducer 30 illustrated in FIG. 4 the support 31 includes an assembly 32 having a circular frame 33 over which a membrane 34 is stretched and secured, the frame 33 being formed at one end of a skeletal cylindrical carrier 35 at the other end of which is formed a blanking disc 36. Disc 36 abuts a spring 37A which engages the top end surface of the housing 31 and the bottom end surface of support 31 carries a driver 37 which is in abutting engagement with the end surface of the membrane 34. This form of transducer 30 therefore has only a single membrane 34 to which electrical leads (not shown) are connected and like the FIG. 1 transducer is sensitive to motion along the axis Z being the longitudinal axis of the support 31 and assembly 32.

Figure 5:
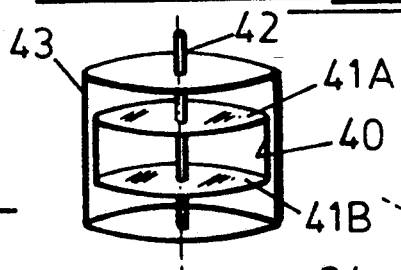
FIG. 5 illustrates another form of acoustic field transducer according to the present invention and including a fifth form of the assembly.

FIG. 5 schematically illustrates an assembly 40 having a pair of membranes 41A, 41B and the driver for these membranes takes the form of a rod 42 penetrating and connected to the upper end wall of the support 43 and penetrating and clamped to each of the membranes 41A, 41B and terminating at a fixed connection with the lower end wall of support 43. The rod 42 may make a screw-threaded connection with the support at each of its ends and may be clamped to the membranes 41A, 41B via clamped washers and associated nuts on the rod. Removal of a central disc of the conductive electrode coating of the film to thereby form an annular electrode disc eliminates contact noise derived from the driver. The same effect can be achieved at the frame edge.

Figure 6:
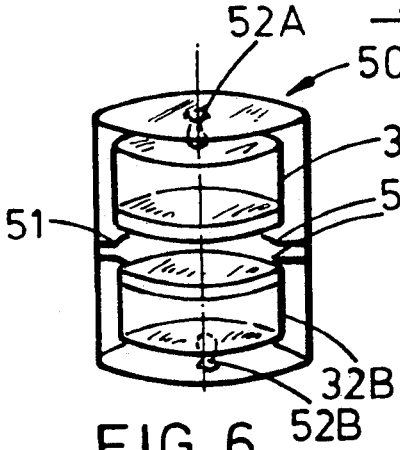
FIG. 6 illustrates another form of acoustic field transducer according to the present invention and including a pair of assemblies of the fourth form.

FIG. 6 illustrates a transducer 50 which incorporates a pair of assemblies 32A, 32B identical to assembly 32 of FIG. 4 but arranged in back-to-back coaxial configuration so that the pertaining discs are proximal. The discs are held apart by leaf springs 51 secured to the support and each end face of the support carries a membrane driver 52A, 52B in abutting engagement with the pertaining membrane.

Figure 7:
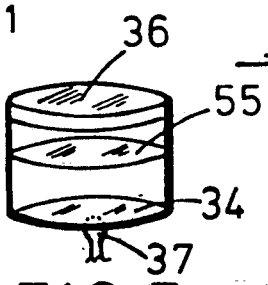
FIG. 7 illustrates a modification of the fourth form of assembly.

FIG. 7 illustrates a modified form of assembly 32 which incorporates a membrane 55 intermediate the disc 36 and the membrane 34 driven by driver 37. Membrane 55 is not driven and is therefore not subject to generation of piezo-electric signals consequential to motion coupled to the assembly from the motion source but is connected electrically in a common mode rejection format with membrane 34 to cancel electro-magnetic and pyroelectric common signals.

Figure 8:
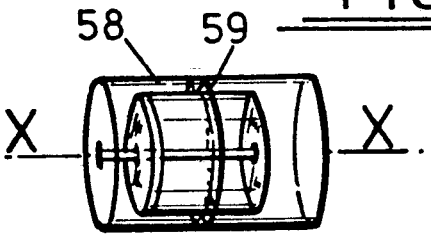
FIG. 8 illustrates a still further form of acoustic field transducer according to the present invention being a modification of the transducer shown in FIG. 5.

The embodiment illustrated in FIG. 8 is similar to that of FIG. 5 except that the device is sensitive to motion about horizontal axis X—X and support for the carrier 58 is provided by a support ring 59.

In the form illustrated in FIG. 9 the transducer 60 comprises a membrane 61 stretched over and secured to a semi-cylindrical frame 62 so that the membrane takes up a semi-cylindrical form. A pair of drivers 63 are provided mounted on a support end wall 64 and the frame 62 is supported by springs 65 secured to another support end wall 66, the transducer 60 being sensitive to vibrations in the plane at right angles to the planar base of the semi-cylindrical frame 62.

In each of the foregoing embodiments the transducer has at least one membrane which is free to move or vibrate in air to follow the motion imparted thereto by a driver affixed to the support which in turn is coupled to the motion source. The membrane is stretched over and secured to a frame which forms an inertial reference, the frame being supported on a support to enable relative movement to occur in at least one translational direction. The driver may abut the membrane or may penetrate the membrane. In the FIG. 5 arrangement the driver penetrates two membranes but this is merely illustrative and the carrier may incorporate several spaced membranes each penetrated by the driver. A static membrane may be mounted on the carrier for connection in common mode rejection format with the driven membrane or membranes. For the convenience of illustration most of the membranes have a circular periphery but other peripheral contours are possible, and as is demonstrated by the FIG. 9 construction, the membrane need not be planar.

FIG. 10 illustrates a still further form of acoustic field transducer 80 comprising a rigid hollow support structure 81 adapted to provide peripheral secural to a pair of membranes 82A, 82B. An inertial mass element 83 is mounted on and carried by the membranes 82A, 82B such that the mass element 83 is free from contact with the support structure 81. The membranes 82A, 82B are held in stretched condition with static strain by their peripheral secural to the structure 81 at clamp rings 84. The clamp rings 84 provide for transfer to the inertial reference formed by element 83 motion of the support structure 81 via the membranes 82A, 82B to effect variations in the strain of the membranes 82A, 82B consequential to that motion and without the requirement to provide separate drivers of the type previously denoted by numeral 16. In the interests of clarity the electrical conductors are not shown but they are connected to the membranes as previously. The FIG. 10 construction is more compact and mechanically simpler than those constructions previously described but provides the same frequency response to acoustic fields. A typical such response is illustrated in FIG. 11 showing output voltage against frequency.

Still further forms of transducers are illustrated in FIGS. 12 and 13. In each case the or each membrane is peripherally clamped as previously to provide for static strain but inertial reference is provided by the support structure 91 having a rigid end wall to which the periphery of the membrane is secured and at least on flexural end wall 92 incorporating a driver 93. The other end wall 94 may be rigid as in FIG. 12 or flexural as in FIG. 13. In FIG. 14 the transducer 100 is formed by uniting the constructions of FIGS. 10 and 13 for the purpose of achieving a noise cancellation transducer particularly suited to hydrophonic applications. More particulary with the FIG. 14 construction the central inertial mass element 83 acts as a motion sensor and pierces both of the membranes on which it is mounted so that these membranes pick up the noise element of the hydrophone signal due to cable motion. The upper and lower membranes 101, 102 are sensitive to pressure variation of the surrounding medium and behave as hydrophone elements. Thus the output of the central motion sensor can be used to cancel out the noise signal picked up by the pressure sensitive hydrophone elements. Additionally if the transducer 100 is subjected to excess pressures it is protected from damage to the membranes by mutual abutment of the mass element 83 and the upper and lower drivers.

I claim:

1. A method of transducing acoustic fields, comprises providing a hollow support structure the exterior of which is exposed to acoustic field variations to be measured and the interior of which forms a fluid tight gas filled plenum; mounting an elastic membrane made of piezo-electric polymeric material within said plenum, the membrane being peripherally held by first mechanical means in a static-strain stretched-condition and having an unsupported major surface area part of which is engaged by second mechanical means, said first and second mechanical means by mutually relatively movable; coupling acoustic field variations incident on the support structure to the membrane via one of said mechanical means whereby to effect a conformal change in strain throughout the membrane; and collecting piezo-electrically generated signals from the membrane as a measure of said acoustic field variations.

2. An acoustic field transducer, comprising: a hollow support structure housing an elastic membrane made of polymeric piezo-electric material and peripherally held by carrier means in stretched condition with static strain, said support structure being sealed against ingress of fluids and the interior of the structure forming a gas filled plenum containing an unsupported major surface area of said membrane, mass means carried by part of said major surface area and free of engagement with said structure, said mass means and carrier means being mutually relatively movable and said carrier means forming part of said structure whereby acoustic field variations incident on the structure are coupled to the membrane to effect a conformal change in strain throughout the membrane, and electrical conductor means connected to the membrane for collecting signals piezo-electrically generated by the membrane due to the conformal change in strain as a measure of said acoustic field variations wherein said first carrier means forms part of an inertial reference assembly mounted for movement relative to the support structure in one translational direction and said second carrier means forms part of said structure, the assembly having a mechanical resonance frequency at or below which the transducer is sensitive to acoustic field frequencies, the output of the transducer being proportional to the relative velocity of motion between the inertial reference assembly and the support structure.

3. An acoustic field transducer, comprising a hollow support structure housing a first elastic membrane made of polymeric piezo-electric material and peripherally held by first carrier means in stretched condition with static strain, said support structure being sealed against ingress of fluids and the interior of the structure forming a gas filled plenum containing an unsupported major surface area of said membrane, mechanical driver means extending from the second carrier means into engagement with part of said major surface area, said first and second carrier means being mutually relatively movable and at least one of said carrier means forming part of said structure whereby acoustic field variations incident on the structure are coupled to the membrane, and electrical conductor means connected to the membrane for collecting signals piezo-electrically generated by the membrane due to conformal changes in strain throughout the membrane which are a measure of said acoustic field variations wherein said first carrier means forms part of an inertial reference assembly mounted for movement relative to the support structure in one translational direction, and said second carrier means forms part of said structure, the assembly having a mechanical resonance frequency at or below which the transducer is sensitive to acoustic field frequencies, the output of the transducer being proportional to the relative velocity of motion between the inertial reference assembly and the support structure.

4. An acoustic field transducer as claimed in claim 3, wherein the support structure has a rigid wall and said first carrier means forms part of said rigid wall, and the support structure has a flexural part and said second carrier means forms a portion of said flexural part.

5. An acoustic field transducer as claimed in claim 4, wherein the rigid wall of the structure is a peripheral wall and the flexural part is a disc mounted at one end of the peripheral wall, the other end of the peripheral wall being closed by a closure disc.

6. An acoustic field transducer as claimed in claim 5, wherein said closure disc is rigid.

7. An acoustic field transducer as claimed in claim 5, wherein said closure disc is flexural and includes a driver engaging part of the major surface area of a further membrane secured in parallel to but spaced from the first membrane and peripherally held in static strain by said first carrier means.

8. An acoustic field transducer as claimed in claim 7, wherein the support structure houses an assembly forming an inertial reference mounted for movement relative to the support structure in one translational direction, the assembly including at least one elastic membrane made of piezo-electric material peripherally held in stretched condition with static strain and having a major surface area which is free from contact with the support structure and which extends transversely to said translational direction in parallel to but spaced from said first and further membranes, said assembly being located axially between said first and further membranes.

9. An acoustic field transducer as claimed in claim 2, wherein said carrier means forms parts of an inertial reference assembly mounted for movement relative to the support structure in one translational direction, and said mass means forms part of said structure, the assembly having a mechanical resonance frequency at or below which the transducer is sensitive to acoustic field frequencies, the output of the transducer being proportional to the relative velocity of motion between the inertial reference assembly and the support structure.

10. An acoustic field transducer, comprising a hollow support structure having a rigid peripheral wall and flexural disc mounted at one end of the peripheral wall, housing a first elastic membrane made of polymeric piezo-electric material forming part of said rigid peripheral wall and peripherally held by first carrier means in stretched condition with static strain, said support structure being sealed against ingress of fluids and the interior of the structure forming a gas filled plenum containing an unsupported major surface area of said membrane, mechanical driver means extending from second driver means forming a portion of said flexural part into engagement with part of said major surface area, said first and second carrier means being mutually relatively movable and at least one of said carrier means forming part of said structure whereby acoustic field variations incident on the structure are coupled to the membrane, and electrical conductor means connected to the membrane for collecting signals piezo-electrically generated by the membrane due to strain variations which are a measure of said acoustic field variations, wherein said closure disc is flexural and includes a driver engaging part of the major surface area of a further membrane secured in parallel to but spaced from the first membrane and peripherally held in static strain by said first carrier means, and wherein the support structure houses an assembly forming an inertial reference mounted for movement relative to the support structure in one translational direction, the assembly including at least one elastic membrane made of piezo-electric material peripherally held in stretched condition with static strain and having a major surface area which is free from contact with the support structure and which extends transversely to said translational direction in parallel to but spaced from said first and further membranes, said assembly being located axially between said first and further membranes.

* * * * *